US010206428B2

(12) United States Patent
Thorens et al.

(10) Patent No.: US 10,206,428 B2
(45) Date of Patent: Feb. 19, 2019

(54) AEROSOL-GENERATING SYSTEM WITH A REPLACEABLE MOUTHPIECE COVER

(71) Applicant: PHILIP MORRIS PRODUCTS S.A., Neuchatel (CH)

(72) Inventors: Michel Thorens, Moudon (CH); Alexis Louvet, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 257 days.

(21) Appl. No.: 14/776,167

(22) PCT Filed: Dec. 20, 2013

(86) PCT No.: PCT/EP2013/077645
§ 371 (c)(1),
(2) Date: Sep. 14, 2015

(87) PCT Pub. No.: WO2014/139609
PCT Pub. Date: Sep. 18, 2014

(65) Prior Publication Data

US 2016/0021933 A1 Jan. 28, 2016

(30) Foreign Application Priority Data

Mar. 15, 2013 (EP) ..... 13159544

(51) Int. Cl.
*A24F 47/00* (2006.01)

(52) U.S. Cl.
CPC ..... *A24F 47/008* (2013.01)

(58) Field of Classification Search
CPC ..... A24F 47/00; A24F 47/008; A24F 1/00; A24F 2700/01; A61M 15/06
(Continued)

(56) References Cited

U.S. PATENT DOCUMENTS 2,624,345 A * 1/1953 Rosenthal ..... A24F 1/00 131/194
3,200,819 A * 8/1965 Gilbert ..... A24F 47/008 128/202.21
(Continued)

FOREIGN PATENT DOCUMENTS

CN 201207922 Y 3/2009
CN 201839801 U 5/2011
(Continued)

OTHER PUBLICATIONS

Notice of Allowance dated Feb. 6, 2017 in Kazak Patent Application No. 2015/1101.1 (with English translation).
(Continued)

*Primary Examiner* — Abdullah Riyami
*Assistant Examiner* — Vladimir Imas
(74) *Attorney, Agent, or Firm* — Oblon, McClelland, Maier & Neustadt, L.L.P.

(57) ABSTRACT

An aerosol-generating device is provided, including a housing containing or configured to receive an aerosol-forming substrate; an outlet formed in the housing, wherein in use aerosol generated from the aerosol-forming substrate is delivered through the outlet, wherein the housing includes a first wall surrounding the outlet and a second wall surrounding the first wall such that an open-ended annular recess is defined between the first and second walls, the annular recess being suitable for retaining a compliant mouthpiece cover to the housing. In use, the mouthpiece cover is placed into a user's mouth in order to directly inhale an aerosol generated by the aerosol-generating device. There is also provided a removable mouthpiece cover for an electrically operated smoking device, including a compliant tubular portion defining a central bore and a filter portion covering the bore of the filter portion.

10 Claims, 3 Drawing Sheets

(58) Field of Classification Search
USPC ..... 131/273, 329, 330
See application file for complete search history.

(56) References Cited

U.S. PATENT DOCUMENTS

| | | | | |
|---|---|---|---|---|
| 4,429,703 | A * | 2/1984 | Haber | A24F 47/002 131/273 |
| 4,922,901 | A * | 5/1990 | Brooks | A24F 47/006 128/202.27 |
| 5,060,671 | A * | 10/1991 | Counts | A24F 47/008 128/202.21 |
| 5,269,327 | A * | 12/1993 | Counts | A24F 47/008 128/200.14 |
| 6,155,268 | A | 12/2000 | Takeuchi | |
| 6,164,287 | A * | 12/2000 | White | A24F 47/008 131/194 |
| 6,418,937 | B1 * | 7/2002 | Cristiano | A24F 1/00 131/199 |
| 7,726,320 | B2 * | 6/2010 | Robinson | A24F 47/008 131/194 |
| 8,430,106 | B2 * | 4/2013 | Potter | A24F 47/004 131/194 |
| 8,499,766 | B1 * | 8/2013 | Newton | A24F 47/008 131/273 |
| 8,528,569 | B1 * | 9/2013 | Newton | A24F 47/008 128/202.21 |
| 8,910,640 | B2 * | 12/2014 | Sears | A24F 47/008 128/202.21 |
| 8,997,753 | B2 * | 4/2015 | Li | H01C 17/00 128/202.21 |
| 9,010,335 | B1 * | 4/2015 | Scatterday | A24F 47/008 128/202.21 |
| 9,078,473 | B2 * | 7/2015 | Worm | A24F 47/008 |
| 9,308,336 | B2 * | 4/2016 | Newton | A61M 15/06 |
| 9,352,288 | B2 * | 5/2016 | Terry | A24F 47/008 |
| 9,609,893 | B2 * | 4/2017 | Novak, III | A24F 47/008 |
| 9,642,397 | B2 * | 5/2017 | Dai | A61M 15/06 |
| 2010/0031968 | A1 * | 2/2010 | Sheikh | A24F 47/008 131/347 |
| 2011/0297166 | A1 | 12/2011 | Takeuchi et al. | |
| 2012/0227753 | A1 * | 9/2012 | Newton | A24F 47/008 131/347 |
| 2013/0037041 | A1 * | 2/2013 | Worm | A24F 47/008 131/329 |
| 2013/0152922 | A1 | 6/2013 | Benassayag et al. | |
| 2013/0180533 | A1 | 7/2013 | Kim et al. | |
| 2013/0263869 | A1 | 10/2013 | Zhu | |
| 2014/0196731 | A1 * | 7/2014 | Scatterday | A45C 13/005 131/329 |
| 2016/0044962 | A1 * | 2/2016 | Thorens | A24F 47/008 392/395 |

FOREIGN PATENT DOCUMENTS

| | | | |
|---|---|---|---|
| CN | 102106611 | A | 6/2011 |
| CN | 102395398 | A | 3/2012 |
| CN | 202664230 | U | 1/2013 |
| DE | 198 54 005 | A1 | 5/2000 |
| DE | 102005016415 | A1 | 11/2006 |
| DE | 102006041042 | A1 | 3/2008 |
| EP | 0 893 071 | A1 | 1/1999 |
| EP | 2399637 | A1 | 12/2011 |
| EP | 2 486 812 | A1 | 8/2012 |
| EP | 2 614 732 | A1 | 7/2013 |
| GB | 2473264 | A | 3/2011 |
| KR | 10-1184758 | B1 | 9/2012 |
| RU | 2 465 791 | C1 | 11/2012 |
| RU | 2 514 220 | C2 | 4/2014 |
| UA | 1007434 | C2 | 1/2013 |
| WO | WO 2009/132793 | A1 | 11/2009 |
| WO | 2012/085203 | A1 | 6/2012 |
| WO | 2012/117578 | A1 | 9/2012 |
| WO | 2012/129787 | A1 | 10/2012 |

OTHER PUBLICATIONS

Combined Chinese Office Action and Search Report dated Jun. 6, 2017 in Patent Application No. 201380074693.2 (with English language translation).

International Search Report and Written Opinion of the International Searching Authority dated Jan. 13, 2015 in PCT/EP2013/077645 filed Dec. 20, 2013.

Chinese Office Action dated May 9, 2018 in corresponding Chinese Application No. 201380074693.2, with English translation, 27 pages.

Notice of Allowance with English translation dated May 7, 2018 in corresponding Russian Patent Application No. 2015142843, (16 pages).

Extended Search Report dated Apr. 1, 2014 in European Patent Application No. 13159544.9.

Taiwanese Office Action and Search Report dated Mar. 2, 2017 in Patent Application No. 102148341 (submitting English translation).

Chinese Office Action and Search Report with English translation dated Dec. 10, 2018 in corresponding Chinese Patent Application No. 201380074693.2 (18 pages).

Product Structure Principles, Ye Dan, Kong Min et al, pp. 49-50, Mechanical Industry Press, Jan. 2010, 1st Edition (4 pages).

* cited by examiner

FIG. 3
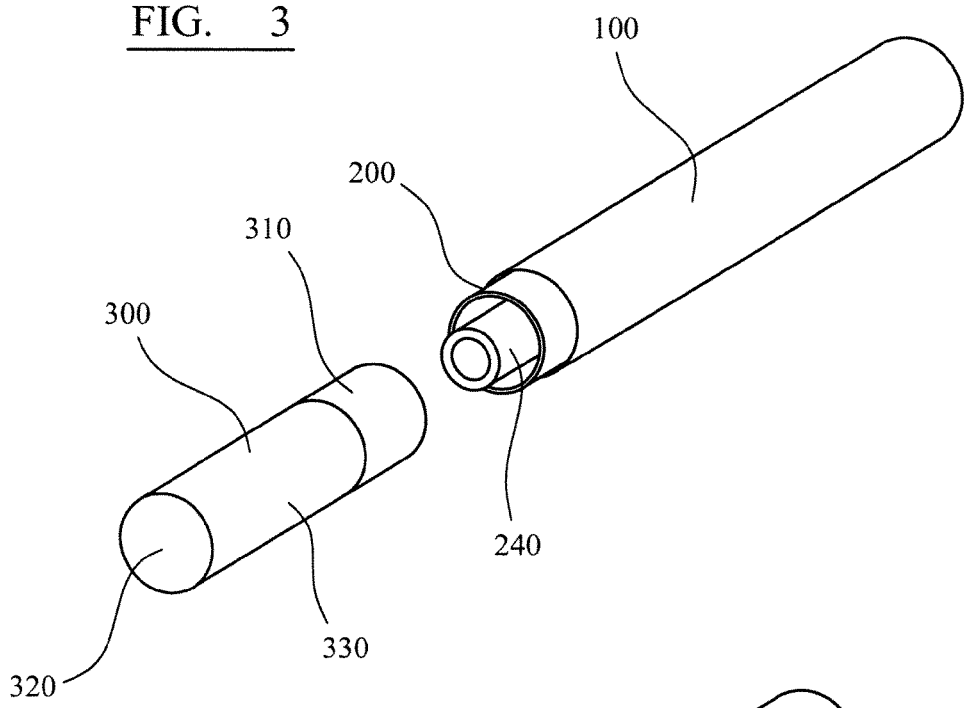
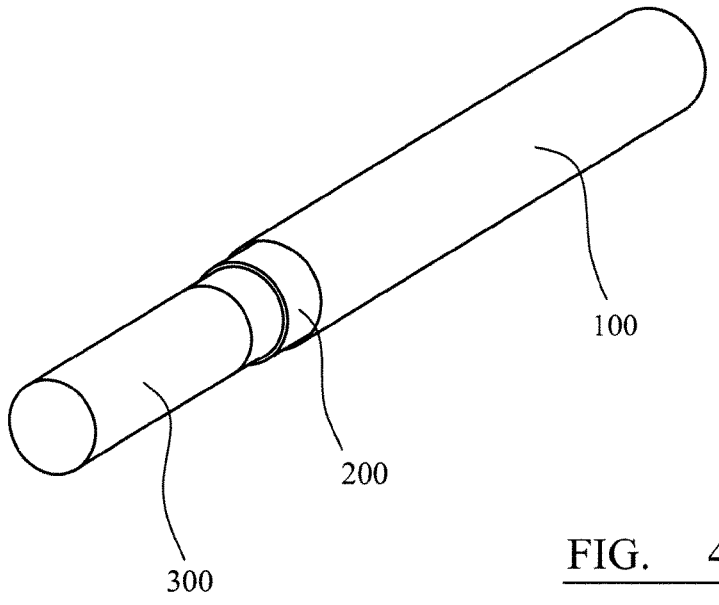
FIG. 4

AEROSOL-GENERATING SYSTEM WITH A REPLACEABLE MOUTHPIECE COVER

TECHNICAL FIELD

The present invention relates to aerosol generating systems. In particular, the present invention relates to aerosol generating systems, such as electrically operating smoking systems, to which a replaceable mouthpiece cover can be easily fitted and removed.

DESCRIPTION OF THE RELATED ART

Electrically heated smoking systems are known in the art. WO-A-2009/132793 discloses an example of an electrically heated smoking system. A liquid is stored in a liquid storage portion, and a capillary wick has a first end which extends into the liquid storage portion for contact with the liquid therein, and a second end which extends out of the liquid storage portion. A heating element heats the second end of the capillary wick. The heating element is in the form of a spirally wound electric heating element in electrical connection with a power supply, and surrounding the second end of the capillary wick. In use, the heating element may be activated by the user to switch on the power supply. Suction on a mouthpiece by the user causes air to be drawn into the electrically heated smoking system over the capillary wick and heating element and subsequently into the mouth of the user.

The substrate used with an aerosol generating device can be provided in a cartridge that can be refilled or replaced when the supply of aerosol-forming substrate has been depleted. Supplying the aerosol-forming substrate in a cartridge has a number of advantages. But there is an opportunity for improvement in the design of such devices.

SUMMARY

It is an objective of the present invention to provide an aerosol-generating device and system that is hygienic, inexpensive and convenient to use.

In one aspect, there is provided an aerosol-generating device comprising:

a housing containing or configured to receive an aerosol-forming substrate;

an outlet formed in the housing, wherein in use aerosol generated from the aerosol-forming substrate is delivered through the outlet;

wherein the housing comprises a first wall surrounding the outlet and a second wall surrounding the first wall such that an open-ended annular recess is defined between the first and second walls, the annular recess being suitable for retaining a compliant mouthpiece cover to the housing.

In use the mouthpiece cover is placed into a user's mouth in order to directly inhale an aerosol generated by the aerosol-generating device. The retention of a replaceable compliant mouthpiece cover between two concentric walls has been found to be an effective solution to the problem of mouthpiece covers becoming disengaged from a housing during use, while allowing for easy mounting and removal of mouthpiece covers.

BRIEF DESCRIPTION OF THE DRAWINGS

Embodiments will now be further described, by way of example only, with reference to the accompanying drawings in which:

FIG. 3 is a perspective view of a system of the type illustrated in FIG. 1 with the mouthpiece cover removed;

FIG. 4 is a perspective view of the system of FIG. 3 with the mouthpiece cover inserted;

DETAILED DESCRIPTION

Figure 1:
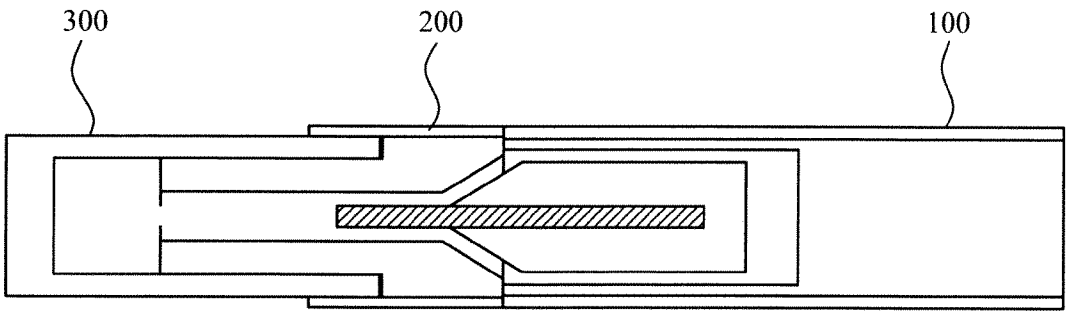
FIG. 1 is a schematic cross section of an aerosol-generating system in accordance with an embodiment of the invention.

The aerosol-generating device may comprise a main body and a cartridge, wherein the cartridge is connectable to the main body and wherein the cartridge contains an aerosol-forming substrate. The first or second wall may be part of the cartridge or may be part of the main body. For example, the first and second walls may be part of the cartridge. Alternatively, the first wall may be part of the cartridge and the second wall may be part of the main body. Alternatively, the first and second walls may be part of the main body. It is also possible that one portion of one of the first and second walls is part of the cartridge and another portion of the one of the first and second walls is part of the main body.

The device may include a gripping mechanism which is operable to grip a mouthpiece cover received in the annular recess to ensure it is retained in the recess during use of the device. For example, a resilient o-ring or helical spring may be received in a groove in the second wall, the o-ring or spring being configured to grip a mouthpiece cover received in the recess. A slidable collar may be provided around the o-ring or spring wherein the slidable collar is movable between a first position in which the collar does not compress the resilient o-ring or spring and a second position in which the collar does compress the resilient o-ring or spring.

The housing may alternatively or additionally include spikes or claws in a closed end of the annular recess configured to pierce or grip a compliant mouthpiece cover received in the recess. The first wall may be of different cross sectional shape to the second wall to provide areas of higher compression on the mouthpiece cover. Alternatively, or in addition, the first of second walls may comprise one or more ridges or bumps extending into the recess to provide areas of higher compression on the mouthpiece cover when it is received in the recess.

The first or second wall, or both the first and second wall, may be formed of a plurality of separate sections and may be continuous or discontinuous.

The term "annular" is intended to mean not just a circular ring shape but a closed loop of any cross-section. However, the first and second walls may be circular so as to define a circularly annular recess.

The term "compliant mouthpiece cover" as used herein means a mouthpiece cover that is pliable and can be readily deformed without breaking or cracking. In particular the compliant mouthpiece cover is preferably readily compressed but resilient.

The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Preferably, the device housing may be elongate. Preferably, the aerosol generating device is portable. The aerosol generating device may be a smoking device and may have a size comparable to a conventional cigar or cigarette. The smoking device may have a total length between approximately 30 mm and approximately 150 mm. The smoking device may have an external diameter between approximately 5 mm and approximately 30 mm.

In another aspect, there is provided a consumable cartridge for an aerosol-generating system, comprising:

a housing containing an aerosol-forming substrate;

an outlet formed in the housing, wherein in use aerosol generated from the aerosol-forming substrate is delivered through the outlet;

wherein the housing comprises a first wall surrounding the outlet and a second wall surrounding the first wall such that an open-ended annular recess is defined between the first and second walls, the annular recess being suitable for retaining a compliant mouthpiece cover to the housing.

In yet another aspect, there is provided a kit for an aerosol-generating system, comprising:

an aerosol-generating device and a compliant mouthpiece cover, the device comprising:

a housing containing or configured to receive an aerosol-forming substrate;

an outlet formed in the housing, wherein in use aerosol generated from the aerosol-forming substrate is delivered through the outlet;

wherein the housing comprises a first wall surrounding the outlet and a second wall surrounding the first wall such that an open-ended annular recess is defined between the first and second walls, the annular recess being suitable for retaining the compliant mouthpiece cover to the housing;

wherein the compliant mouthpiece cover comprises a tubular section configured to fit in the annular recess and is configured to allow aerosol delivered through the outlet to pass through the mouthpiece cover and into the mouth of a user in use.

The mouthpiece cover may be configured to slide into the annular recess so that the tubular section is retained in the annular recess. The annular recess may be dimensioned so that the tubular portion of the mouthpiece cover is radially compressed between the first wall and the second wall when the mouthpiece cover is engaged with the recess.

The mouthpiece cover or the housing, or both the mouthpiece cover and the housing may be shaped to aid insertion of the mouthpiece cover into the annular recess. For example, the second wall may be flared so that the annular recess has a larger cross-section at its open end. Similarly, the mouthpiece cover may be tapered at an insertion end, where the insertion end is the end of the mouthpiece cover that is first received by the annular recess during engagement of the mouthpiece cover with the housing.

The mouthpiece cover may comprise a filter portion connected to the tubular portion, the filter portion covering a bore of the tubular section. The filter portion may have low filtration efficiency. The filter portion may be used to provide a desired resistance to draw for the aerosol-generating system.

The mouthpiece cover can be used for a single user session or smoking experience and then discarded. A new mouthpiece cover can be provided when the system is to be used again. This reduces the risk of build up of undesirable residues and pathogens on the mouthpiece cover portion and reduces the cleaning burden on the user. Alternatively, the mouthpiece cover may be cleaned after each use and then reused.

The removable mouthpiece cover may mimic the filter of a conventional cigarette in look and feel. For example, the removable mouthpiece cover may be formed from cellulose acetate, rubber, or plastic, such as polyethylene or polypropylene or a mixture of both, and may be covered with a paper layer.

The aerosol-generating device may be a smoking device. The device may contain sufficient aerosol-forming substrate for a plurality of smoking sessions. In that case the kit may comprise a plurality of mouthpiece covers. In particular, the device may contain sufficient aerosol-forming substrate for a predetermined number of average smoking sessions and the kit may contain that predetermined number of mouthpiece covers so that a different mouthpiece cover may be used for each smoking session.

The smoking device may comprise a main body and a cartridge, wherein the cartridge is connectable to the main body and wherein the cartridge contains an aerosol-forming substrate.

In yet another aspect there is provided a kit for an aerosol-generating system, comprising:

a consumable cartridge for an aerosol-generating system, the cartridge contain an aerosol-forming substrate; and a plurality of compliant mouthpiece covers The aerosol-generating system may be a smoking system. The cartridge may contain sufficient aerosol-forming substrate for a predetermined plurality of average smoking sessions and the kit may contain that predetermined number of mouthpiece covers so that a different mouthpiece cover may be used for each smoking session.

The consumable cartridge may comprise:

a housing containing the aerosol-forming substrate; and an outlet formed in the housing, wherein in use aerosol generated from the aerosol-forming substrate is delivered through the outlet;

wherein the housing comprises a first wall surrounding the outlet and a second wall surrounding the first wall such that an open-ended annular recess is defined between the first and second walls, the annular recess being suitable for retaining a compliant mouthpiece cover to the housing.

The compliant mouthpiece covers may comprise a tubular section configured to fit in the annular recess and being configured to allow aerosol delivered through the outlet to pass through the mouthpiece cover and into the mouth of a user in use.

For all aspects of the invention, the aerosol forming substrate may be a liquid aerosol forming substrate. The aerosol-forming substrate may contain nicotine. The aerosol-forming substrate may be adsorbed, coated, impregnated or otherwise loaded onto a carrier or support. The aerosol-forming substrate may be a solid substrate.

In some embodiments, the device or cartridge comprises a capillary wick in communication with the supply or aerosol-forming substrate. It is also possible for a capillary wick to be preloaded with liquid, forming the supply of aerosol-forming substrate.

Preferably, the capillary wick is arranged to be in contact with liquid in a liquid storage portion of the device or cartridge. In that case, in use, liquid is transferred from the liquid storage portion towards the at least one electric heating element by capillary action in the capillary wick. In one embodiment, the capillary wick has a first end and a second end, the first end extending into the liquid storage portion for contact with liquid therein and at least one electric heating element is arranged to heat liquid in the second end. When the heating element is activated, the liquid at the second end of the capillary wick is vaporized by the heating element to form the supersaturated vapour. The supersaturated vapour is mixed with and carried in the airflow. During the flow, the vapour condenses to form the aerosol and the aerosol is carried towards the mouth of a user though the outlet and mouthpiece cover. The heating element in combination with a capillary wick may provide a fast response, because that arrangement may provide a high surface area of liquid to the heating element. Control of the heating element according to the invention may therefore depend on the structure of the capillary wick arrangement.

A liquid substrate may be absorbed into a porous carrier material, which may be made from any suitable absorbent plug or body. For example, any suitable absorbent plug or body may be a foamed metal or plastics material, polypropylene, terylene, nylon fibres or ceramic. The liquid substrate may be retained in the porous carrier material prior to use of the electrically heated aerosol generating device or alternatively, the liquid substrate material may be released into the porous carrier material during, or immediately prior to use. For example, the liquid substrate may be provided in a capsule. The shell of the capsule preferably melts upon heating and releases the liquid substrate into the porous carrier material. The capsule may optionally contain a solid in combination with the liquid.

If the aerosol-forming substrate is a liquid substrate, the liquid must have suitable physical properties. These include, for example, a boiling point, vapour pressure, and surface tension characteristics to make them suitable for use in the aerosol generating device. Control of the at least one electric heating element may depend upon the physical properties of the liquid substrate. The liquid may comprise a tobacco-derived material comprising volatile tobacco flavour compounds which are released from the liquid upon heating. Alternatively, or in addition, the liquid may comprise a non-tobacco material. The liquid may include water, solvents, ethanol, plant extracts and natural or artificial flavours. Preferably, the liquid further comprises an aerosol former. Examples of suitable aerosol formers are glycerine and propylene glycol. The liquid preferably comprises a mix of aerosol formers e.g. glycerine, propylene glycol; a water fraction, nicotine and flavours.

An advantage of providing a liquid storage portion is that a high level of hygiene can be maintained. Using a capillary wick extending between the liquid and the electric heating element, allows the structure of the device to be relatively simple. The liquid has physical properties, including viscosity and surface tension, which allow the liquid to be transported through the capillary wick by capillary action.

The capillary body may comprise any suitable material or combination of materials which is able to convey the liquid aerosol-forming substrate towards the vaporizer. The capillary body preferably comprises a porous material, but this need not be the case. The capillary body may have the form of a wick. The capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in the longitudinal direction of the aerosol generating device. Alternatively, the capillary wick may comprise sponge-like or foam-like material formed into a rod shape. The rod shape may extend along the longitudinal direction of the aerosol-generating device. The structure of the wick forms a plurality of small bores or tubes, through which the liquid can be transported to the electric heating element, by capillary action. The capillary wick may comprise any suitable material or combination of materials. Examples of suitable materials are ceramic-based or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid, ensure that the wick is always wet in the heating area.

Preferably, the cartridge includes an electrically operated aerosol generating element and electrical contacts for connection of the aerosol generating element to a power supply contained in the device. The electrically operated aerosol generating element is preferably an electric heater.

The electric heater may comprise a single heating element. Alternatively, the electric heater may comprise more than one heating element, for example two, or three, or four, or five, or six or more heating elements. The heating element or heating elements may be arranged appropriately no as to most effectively heat the aerosol-forming substrate.

In a preferred embodiment, the at least one heating element is a coil of electrically resistive wire. The pitch of the coil is preferably between 0.5 and 1.5 mm, and most preferably approximately 1.5 mm. The pitch of the coil means the spacing between adjacent turns of the coil. The coil may advantageously comprise fewer than six turns, and preferably has fewer than five turns.

The at least one electric heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel. Constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel. Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America.

In a preferred embodiment, in which the at least one heating element is a coil of electrically resistive wire, and the electrically resistive wire advantageously has a diameter of between 0.10 and 0.15 mm, and preferably of approximately 0.125 mm. The electrically resistive wire is preferably formed of 904 or 301 stainless steel.

Alternatively, the at least one electric heating element may comprise an infra-red heating element, a photonic source, or an inductive heating element.

The heating element may take any suitable form. For example, the heating element may take the form of a heating blade. Alternatively, the heating element may take the form of a casing or substrate having different electro-conductive portions, or an electrically resistive metallic tube. If the aerosol-forming substrate is a liquid provided within a container, the container may incorporate a disposable heating element. Alternatively, one or more heating needles or rods that run through the centre of the aerosol-forming substrate may also be suitable. Alternatively, the heating element may be a disk (end) heating element or a combination of a disk heating element with heating needles or rods. Alternatively, the heating element may comprise a flexible sheet of material arranged to surround or partially surround the aerosol-forming substrate. Other alternatives include a heating wire or filament, for example a Nickel Chromium (Ni—Cr), platinum, tungsten or alloy wire, or a heating plate. Optionally, the heating element may be deposited in or on a rigid carrier material.

The heating element may heat the aerosol-forming substrate by means of conduction. The heating element may be at least partially in contact with the substrate, or the carrier on which the substrate is deposited. Alternatively, the heat from the heating element may be conducted to the substrate by means of a heat conductive element.

Alternatively, the heating element may transfer heat to the incoming ambient air that is drawn through the electrically heated aerosol generating device during use, which in turn heats the aerosol-forming substrate by convection. The ambient air may be heated before passing through the aerosol-forming substrate. Alternatively, if the aerosol-forming substrate is a liquid substrate, the ambient air may be first drawn through the substrate and then heated.

Preferably the device includes electric circuitry for controlling the operation of the device. The electric circuitry may comprise a microcontroller. The microcontroller may include a proportional-integral-derivative (PID) regulator for controlling the power supplied to a heating element. The electric circuitry may be included in the cartridge and may be the functional element in the insertion portion of the cartridge.

The device may include a flow sensor for detecting a flow rate of gas through the device. The sensor may be any sensor which can detect airflow, such as would be indicative of a user inhaling. The sensor may be an electro-mechanical device. Alternatively, the sensor may be any of: a mechanical device, an optical device, an opto-mechanical device, a micro electro mechanical systems (MEMS) based sensor and an acoustic sensor. The sensor can be a thermal conductive flow sensor, a pressure sensor, an anemometer and should be able to not only detect an airflow but should be able to measure the airflow. So, the sensor should be able to deliver an analogue electrical signal or digital information that is representative of the amplitude of the air flow. The flow sensor may be positioned in the main body of the device or in the cartridge.

The aerosol generating device may comprise an aerosol-forming chamber in which aerosol forms from a super saturated vapour, which aerosol is then carried into the mouth of a user. An air inlet and the chamber are preferably arranged so as to define an airflow route from the air inlet to the outlet via the aerosol-forming chamber, so as to convey the aerosol to the air outlet and into the mouth of a user. In a system comprising a cartridge containing the aerosol-forming substrate, the aerosol-forming chamber is preferably in the cartridge.

In a further aspect, there is provided a removable mouthpiece cover for an electrically operated smoking device, comprising a compliant tubular portion defining a central bore and a filter portion covering the bore of the filter portion.

The tubular portion may be formed of cellulose acetate. The filter portion may also be formed from cellulose acetate. The tubular portion and the filter portion may be formed from biodegradable materials. The mouthpiece cover may mimic the filter of a conventional cigarette in look and feel, for example in smoothness and pliability.

It should be clear that features described in relation to one aspect of the invention may be applicable to another aspect of the invention. In particular, it should be clear that features described in relation to one aspect may equally be applied to another aspect and that many of the features described in relation to the cartridge of one aspect may equally be included in the main body of the device of the other aspect.

FIG. 1 is a schematic cross section of an aerosol generating system in accordance with an embodiment of the invention. The system comprises of a main body 100, a cartridge 200 and mouthpiece cover 300.

Figure 2:
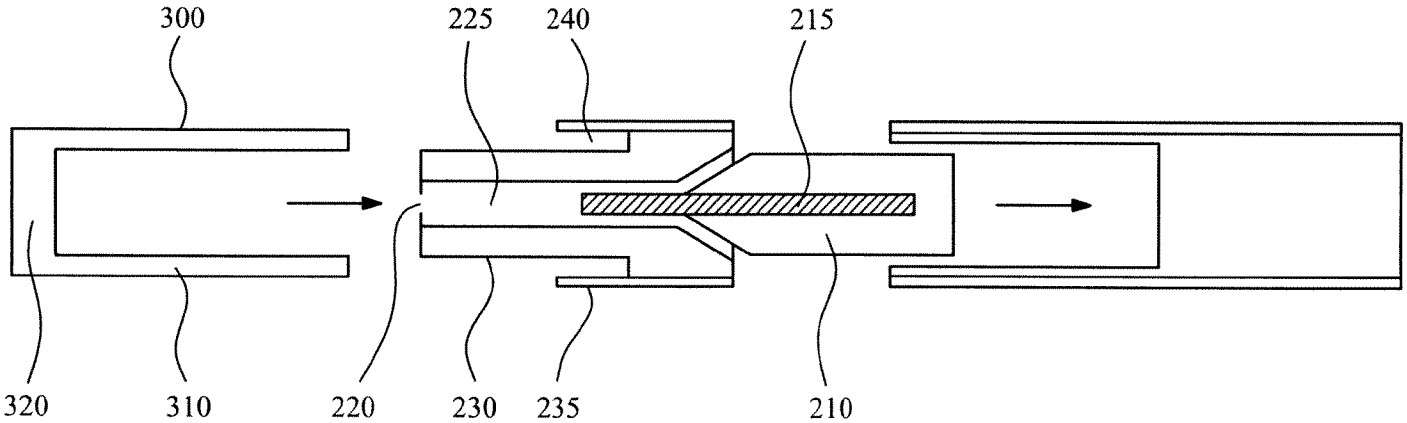
FIG. 2 shows the system of FIG. 1 in a dissembled state.

FIG. 2 shows the system of FIG. 1 in a dissembled state with the three components of the main body 100, cartridge 200 and mouthpiece cover 300 shown separate from one another.

The system shown in FIGS. 1 and 2 is of the type described in WO2009/132793.

The main body 100 of the system has an electrical power supply, in the form of a battery and electric circuitry in the form of hardware. The cartridge 200, has an aerosol forming substrate within a liquid storage portion 210 and a heater (not shown) that, in use, vaporises the aerosol forming substrate to form an aerosol. A capillary wick 215 extends from within the liquid storage portion 210, to a position within an aerosol forming chamber 225. The heater is in the form of a resistive heating element, such as a coil heater, in contact with the capillary wick. Power to the electric heater is supplied from the battery within the main body 100. Electrical contact is made between the cartridge 200 and the main body 100 when they are in an assembled condition, as shown in FIG. 1.

An air inlet or inlets (not shown), which may be formed in either the main body 100 or the cartridge 200, or between the main and the cartridge, allow air to enter the device and from there pass through the aerosol forming chamber 225 to an outlet 220. In use, the air is drawn through the air inlet to the air outlet by the action of a user sucking or inhaler on the mouthpiece cover 300. Ambient air enters the air inlet or air inlets and passes the heating element and capillary wick where it entrains vaporised aerosol forming substrate. The vaporised aerosol forming substrate then cools to form an aerosol before exiting through the outlet 220.

A puff detection system (not shown) provided in the main body or in the cartridge, senses the user taking a puff on the mouthpiece cover. The battery then supplies energy to the heating element to heat the end of the wick surrounded by the heating element. The liquid aerosol-forming substrate in that end of the wick is vaporised by the heating element to create a super saturated vapour. At the same time, the liquid being vaporised is replaced by further liquid being drawn up through the wick by capillary action. The super saturated vapour that is created is mixed with and carried in the air flow. As previously described, the vapour condenses in the aerosol forming chamber to form an inhalable aerosol which is carried through the outlet 220 and into the mouth of the user.

In this embodiment, the mouthpiece cover 300 engages with the cartridge 200. The mouthpiece cover 300 is formed of cellulose acetate, covered with an external paper layer. The mouthpiece cover comprises a tubular portion 310 and a filter portion 320. The tubular portion of the mouthpiece cover slides over a first wall 230 of the cartridge, but inside a second wall 235 of the cartridge. First and second walls of the cartridge define an annular recess 240 in which a portion of the tubular portion of the mouthpiece cover is retained, as shown in FIG. 1.

In this embodiment, the mouthpiece cover, cartridge and main body are all of circular cross section, as can be seen more clearly in FIGS. 3 and 4. FIG. 3 shows a device of the type shown in FIG. 1 and FIG. 2 with the mouthpiece cover 300 separate from the main body 100 and the cartridge 200. FIG. 4 shows the system with the mouthpiece cover 300 engaged by the recess 240 in the cartridge 200. The system in the configuration of FIG. 4 is ready for use.

In order to ensure that the mouthpiece cover is retained in the recess 240 during use, the recess 240 is dimensioned to compress the tubular portion 310 of the mouthpiece cover 300. The tubular portion of the mouthpiece cover is formed of a material that is readily compressed but is resilient. The open end of the recess 240 may be flared in order to allow for easy insertion of the mouthpiece cover 300 in to the recess 240. An insertion and of the mouthpiece cover 300 may also be tapered in order to ensure easy insertion of the mouthpiece cover in to the recess. The first wall 230 may also be tapered to allow for easy insertion of a mouthpiece cover but increasing compression of the mouthpiece filter as it is fully inserted into the recess.

A plurality of mouthpiece covers 300 may be provided in a single package, possibly with a cartridge 200. The mouthpiece covers may be packaged so that when the package is opened the open ends of the tubular portions 310 face outwards from the package. A user would then simply need to introduce the device (i.e. the cartridge 200 assembled to the main body) into a selected mouthpiece cover, thereby inserting the mouthpiece cover into the recess without having to remove the mouthpiece cover from the package and insert in manually. After a smoking session, the used mouthpiece cover can be pulled out of the recess and disposed of or cleaned.

The mouthpiece covers may provide very little filtration of the aerosol if desired. Alternatively, the filter portion 320 may be made thicker or formed differently to provide significant filtration of the aerosol as desired.

The first and second walls of this embodiment are formed from polypropylene and are injection moulded. However, any suitable material and manufacturing process may be used. In order to enhance the retention of the mouthpiece cover 300 in the recess 240 additional elements may be provided. For example, a plurality of moulded spikes or barbs may be provided within the recess that each act to grip mouthpiece covers. Alternatively, one or more ridges or bumps may be provided on the first or second walls. The ridges or bumps may be formed from a compliant material.

Figure 5A:
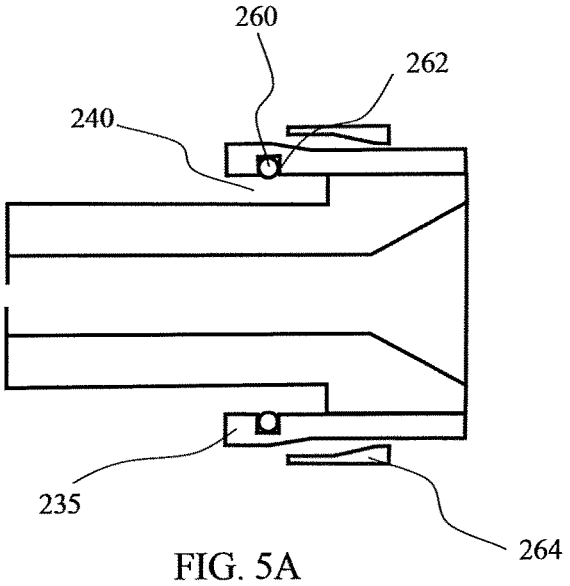
FIG. 5A is a schematic cross-section of part of a cartridge of an aerosol-generating system in accordance with an embodiment and showing a slidable collar of a tightening mechanism in a first position.
Figure 5B:
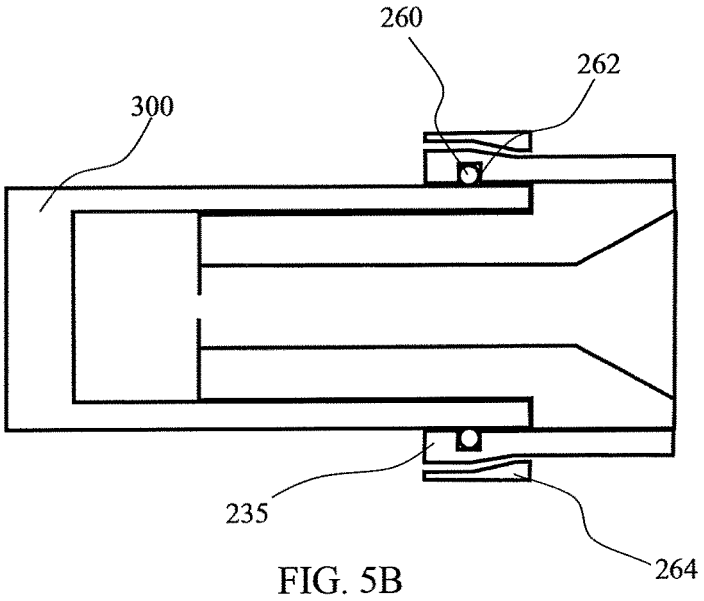
FIG. 5B is a schematic cross-section of the part of the cartridge of FIG. 5A showing a mouthpiece cover inserted and the slidable collar of the tightening mechanism in a second position.

A tightening mechanism may be provided to allow for manually actuated gripping of the mouthpiece cover 300 following insertion into the recess 240. For example, FIGS. 5A and 5B show a resilient o-ring or helical spring 260 may be received in a groove 262 in the second wall 235, the o-ring or spring 260 being configured to grip a mouthpiece cover 300 received in the recess 240. A slidable collar 264 may be provided around the o-ring or spring 260 wherein the slidable collar 264 is movable between a first position (see FIG. 5A), in which the collar 264 does not compress the resilient o-ring or spring, and a second position (see FIG. 5B), in which the collar 264 does compress the resilient o-ring or spring 260.

A mouthpiece cover and aerosol-generating device in accordance with the invention has several advantages, in particular for an electrically operated smoking system. A new mouthpiece may be used for each smoking session. This improves hygiene and allows a smoking system to be shared between users more readily. The mouthpiece cover may be made to have the same dimensions, look and feel as a conventional cigarette, which is preferred by may users. The mouthpiece covers can be manufactured using the same materials, processes and technology as conventional cigarette filters, which are already produced inexpensively and in high volumes. The use of the same materials as conventional filters also has the advantage that these filters have been exhaustively tested for the conventional cigarette market and are known to be suitable for use as a mouthpiece cover.

It should be clear that many variations are possible to the embodiment described with reference to FIGS. 1 to 4. For example, the relative lengths of the first and second walls may be different, and the length of the mouthpiece cover may be altered to suit user preference or aesthetics.

Furthermore, the mouthpiece cover and its retention in an annular recess may be used with different constructions on aerosol-generating system. For example, an aerosol-generating device may be configured so that the cartridge is held entirely within a main housing. In that case, the second wall, and possibly also the first wall would be part of the main housing. Alternatively, the cartridge may comprise the first wall and the main housing comprises the second wall. The cartridge may even comprise only a portion or the first or second wall, or a portion of both the first and second wall.

The aerosol-generating device may not include a separate cartridge and main housing. Instead the main housing may contain the aerosol-forming substrate. In that case, the device may be refillable with substrate or may be disposed of when the substrate has been consumed.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. A kit for an aerosol-generating system, comprising:

an aerosol-generating device and a compliant, readily compressed but resilient, mouthpiece cover, the device comprising:

a housing containing or configured to receive an aerosol-forming substrate; and an outlet formed in the housing, wherein aerosol generated from the aerosol-forming substrate is delivered through the outlet, wherein the housing comprises a first wall surrounding the outlet and a second wall surrounding the first wall such that an open-ended annular recess is defined between the first and second walls, the annular recess being configured to retain the compliant mouthpiece cover to the housing, wherein the compliant mouthpiece cover comprises a tubular section configured to fit in the annular recess and being configured to allow aerosol delivered through the outlet to pass through the mouthpiece cover and into the mouth of a user, wherein the aerosol-generating device is a smoking device and contains sufficient aerosol-forming substrate for a plurality of smoking sessions, wherein the aerosol-generating device further comprises:

a resilient O-ring or helical spring received in a groove in the second wall, and a slidable collar, wherein the slidable collar is moveable between a first position in which the slidable collar does not compress the O-ring or helical spring and a second position in which the slidable collar compresses the O-ring or helical spring to grip the compliant mouthpiece cover when the compliant mouthpiece cover is received in the annular recess, and wherein the kit comprises a plurality of mouthpiece covers.

2. The kit according to claim 1, wherein the tubular section of the mouthpiece cover is configured to slide into the annular recess.

3. The kit according to claim 1, wherein the annular recess is dimensioned so that the tubular section of the mouthpiece cover is radially compressed between the first wall and the second wall when the mouthpiece cover is engaged with the recess.

4. The kit according to claim 1, wherein the mouthpiece cover comprises a filter portion connected to the tubular section, the filter portion covering a bore of the tubular section.

5. The kit according to claim 1, wherein the removable mouthpiece cover is formed from cellulose acetate and is covered with a paper layer.

6. A kit for an aerosol-generating system, comprising:

a consumable cartridge for an aerosol-generating system, the cartridge comprising:

a housing containing an aerosol-forming substrate; and an outlet formed in the housing, wherein aerosol generated from the aerosol-forming substrate is delivered through the outlet; and a plurality of compliant, readily compressed but resilient, mouthpiece covers, the compliant mouthpiece covers each comprising a tubular section and a filter portion connected to the tubular portion, the filter portion covering a bore of the tubular section, wherein the housing comprises a first wall surrounding the outlet and a second wall surrounding the first wall such that an open-ended annular recess is defined between the first and second walls, the annular recess being configured to retain one of the plurality of compliant mouthpiece covers to the housing, and wherein the cartridge further comprises:

a resilient O-ring or helical spring received in a groove in the second wall, and a slidable collar, wherein the slidable collar is moveable between a first position in which the slidable collar does not compress the O-ring or helical spring and a second position in which the slidable collar compresses the O-ring or helical spring to grip a compliant mouthpiece cover when the compliant mouthpiece cover is received in the annular recess.

7. The kit according to claim 6, wherein the aerosol-generating system is a smoking system.

8. A kit for an aerosol-generating system, comprising:

an aerosol-generating device and a compliant, readily compressed but resilient, mouthpiece cover, the device comprising:

a housing containing or configured to receive an aerosol-forming substrate; and an outlet formed in the housing, wherein aerosol generated from the aerosol-forming substrate is delivered through the outlet, wherein the housing comprises a first wall surrounding the outlet and a second wall surrounding the first wall such that an open-ended annular recess is defined between the first and second walls, the annular recess being configured to retain the compliant mouthpiece cover to the housing, wherein the compliant mouthpiece cover comprises a tubular section configured to fit in the annular recess and being configured to allow aerosol delivered through the outlet to pass through the mouthpiece cover and into the mouth of a user, wherein the mouthpiece cover comprises a filter portion connected to the tubular section, the filter portion covering a bore of the tubular section, and wherein the aerosol-generating device further comprises:

a resilient O-ring or helical spring received in a groove in the second wall, and a slidable collar, wherein the slidable collar is moveable between a first position in which the slidable collar does not compress the O-ring or helical spring and second position in which the slidable collar compresses the O-ring or helical spring to grip the compliant mouthpiece cover when the compliant mouthpiece cover is received in the annular recess.

9. A kit for an aerosol-generating system, comprising:

an aerosol-generating device and a compliant, readily compressed but resilient, mouthpiece cover, the device comprising:

a housing containing or configured to receive an aerosol-forming substrate; and an outlet formed in the housing, wherein aerosol generated from the aerosol-forming substrate is delivered through the outlet, wherein the housing comprises a first wall surrounding the outlet and a second wall surrounding the first wall such that an open-ended annular recess is defined between the first and second walls, the annular recess being configured to retain the compliant mouthpiece cover to the housing, wherein the compliant mouthpiece cover comprises a tubular section configured to fit in the annular recess and being configured to allow aerosol delivered through the outlet to pass through the mouthpiece cover and into the mouth of a user, wherein the removable mouthpiece cover is formed from cellulose acetate and is covered with a paper layer, and wherein the aerosol-generating device further comprises:

a resilient O-ring or helical spring received in a groove in the second wall, and a slidable collar, wherein the slidable collar is moveable between a first position in which the slidable collar does not compress the O-ring or helical spring and second position in which the slidable collar compresses the O-ring or helical spring to grip the compliant mouthpiece cover when the compliant mouthpiece cover is received in the annular recess.

10. The kit according to claim 3, wherein the first or second wall comprise one or more ridges or bumps extending into the recess and being configured to provide areas of higher compression on the mouthpiece cover when the mouthpiece cover is received in the annular recess.

* * * * *